US011326397B2

(12) United States Patent
Lei et al.

(10) Patent No.: US 11,326,397 B2
(45) Date of Patent: May 10, 2022

(54) ROLLER SHADE ACTUATION DEVICE

(71) Applicant: Leafy Windoware Co., Ltd., Dongguan (CN)

(72) Inventors: Zhenbang Lei, Dongguan (CN); Xingbang Lei, Dongguan (CN)

(73) Assignee: Leafy Windoware Co., Ltd., Dongguan (CN)

( * ) Notice: Subject to any disclaimer, the term of this patent is extended or adjusted under 35 U.S.C. 154(b) by 0 days.

(21) Appl. No.: 16/910,076

(22) Filed: Jun. 24, 2020

(65) Prior Publication Data

US 2020/0408038 A1 Dec. 31, 2020

(30) Foreign Application Priority Data

Jun. 25, 2019 (CN) ..... 201920967847.8

(51) Int. Cl.
*E06B 9/68* (2006.01)
*E06B 9/42* (2006.01)
*E06B 9/60* (2006.01)

(52) U.S. Cl.
CPC ..... *E06B 9/68* (2013.01); *E06B 9/42* (2013.01); *E06B 9/60* (2013.01)

(58) Field of Classification Search
CPC .... E06B 9/40; E06B 9/322; E06B 2009/3222; E06B 2009/3225; E06B 9/60; E06B 9/42; E06B 9/56; E06B 9/68
See application file for complete search history.

(56) References Cited

U.S. PATENT DOCUMENTS 8,002,012 B2 * 8/2011 Cheng ..... E06B 9/322 160/170
8,820,385 B2 * 9/2014 Wu ..... E06B 9/322 160/173 R
10,113,359 B1 * 10/2018 Chen ..... E06B 9/60
2010/0319860 A1 * 12/2010 DeWard ..... E06B 9/323 160/315
2013/0312920 A1 * 11/2013 Mullet ..... E06B 9/42 160/310
2016/0340975 A1 * 11/2016 Huang ..... E06B 9/322
2017/0016274 A1 * 1/2017 Zheng ..... E06B 9/304
2017/0081914 A1 * 3/2017 Wu ..... E06B 9/266
2017/0204656 A1 * 7/2017 Chen ..... E06B 9/322
2018/0230744 A1 * 8/2018 Huang ..... E06B 9/322

* cited by examiner

*Primary Examiner* — Johnnie A. Shablack
*Assistant Examiner* — Matthew R. Shepherd

(57) ABSTRACT

A roller shade actuation device includes a driver arranged in a winding drum, a shaft fixed to a support frame outside one end of the winding drum and inserted into the winding drum, and a transmission mechanism for realizing power transmission between the driver and the shaft. The driver includes a housing relatively fixed to the winding drum, a rotation power member arranged in the housing, and a driving gear coaxial with and fixed to an output shaft of the rotation power member. The transmission mechanism includes a first transmission gear meshed with the driving gear, a synchronous gear coaxial with the first transmission gear, and a fixed gear fixed to the shaft and meshed with the synchronous gear. Axial directions of the output shaft and the shaft are vertical, and the synchronous gear and the fixed gear are bevel gears whose axial directions are perpendicular to each other.

15 Claims, 3 Drawing Sheets

ROLLER SHADE ACTUATION DEVICE

BACKGROUND OF THE INVENTION

1. Field of the Invention

The present invention relates to window shade technical field and, more particularly to a roller shade actuation device.

2. Description of Related Art

Opposite ends of a winding drum of a current spring roller shade are mounted to corresponding frames, and a spring end, a coil spring, a damper, and a limiter are arranged in order from an end to an opposite end in the winding drum. When the shade body needs to be put down, the shade body only needs to be pulled down, and the shade body will drive the winding drum to rotate and then rotate relative to the coil spring. The coil spring is twisted and deformed to accumulate elastic force. At the same time, by means of the damper, the shade body can be held at any height position within the effective range of the shade body. When the shade body needs to be rolled up, the shade body only needs to be pushed up, and the force of the coil spring overcomes the damping action of the damper to drive the winding drum to rotate in an opposite direction, thereby rewinding the shade body on the winding drum. An output shaft of a driver of the current spring roller shade and the winding drum are arranged in parallel in the axial direction, and flat scroll springs are all set parallel to the output shaft, which makes the overall roller shade actuation device take up a great volume, and the assembly structure is also complicated.

SUMMARY OF THE INVENTION

Therefore, the technical problem to be solved by the embodiments of the present invention is to provide a roller shade actuation device, which effectively reduces the occupied volume.

To solve the above-mentioned technical problems, an embodiment of the present invention provides a roller shade actuation device for actuating a winding drum with opposite ends rotatably mounted to corresponding support frames and an outer surface mounted with an end of a shade body. The roller shade actuation device includes a driver arranged in the winding drum, a shaft fixed to the support frame outside one end of the winding drum and inserted into the winding drum, and a transmission mechanism for realizing power transmission between the driver and the shaft. The driver includes a housing relatively fixed to the winding drum, a rotation power member arranged in the housing, and a driving gear fixed to an output shaft of the rotation power member and coaxial with the output shaft. The transmission mechanism includes a first transmission gear meshed with the driving gear, a synchronous gear coaxial with and relatively fixed to the first transmission gear, and a fixed gear fixed to the shaft and meshed with the synchronous gear. An axial direction of the output shaft of the rotation power member is perpendicular to an axial direction of the shaft, and the synchronous gear and the fixed gear are bevel gears whose axial directions are perpendicular to each other.

Furthermore, the rotation power member further includes a plane scroll spring and a spring winding frame for winding the plane scroll spring, the plane scroll spring and the output shaft is arranged in parallel in the axial direction, and an outer end of a reed of the plane scroll spring is fixed to a side surface of the output shaft.

Furthermore, the rotation power member includes at least two plane scroll springs that are coaxially wound on the same spring winding frame, the spring winding frame and the output shaft each are provided with a partition that partitions adjacent plane scroll springs.

Furthermore, the first transmission gear, the synchronous gear, and the fixed gear are all disposed in a gear box, a sidewall of the gear box adjacent to the driver defines a slot, through which teeth of the first transmission gear extends out; a gear shaft of the fixed gear extends through a sidewall of the gear box adjacent to the shaft to be fixedly connected to the shaft.

Furthermore, the roller shade actuation device includes at least two sequentially linearly connected drivers. Each driver further includes a second transmission gear rotatably mounted to the housing and meshed with the driving gear; the driving gear of one of the drivers neighboring the gear box is meshed with the teeth of the first transmission gear extending out of the gear box, and the driving gears of the remaining drivers are meshed with the second transmission gears of the neighboring drivers adjacent to the gear box.

Furthermore, the sidewall of the gear box adjacent to the driver forms a first hook, opposite ends of the housing of the driver respectively form a second hook and a hooking portion; the hooking portion of the driver neighboring the gear box is engaged with the first hook of the gear box, and the hooking portions of the remaining drivers are engaged with the second hooks of the neighboring drivers adjacent to the gear box, so as to linearly connect the gear box and the drivers one after another.

Furthermore, the housing includes a base and a cover which are engaged with each other, a side surface of the cover away from the base is a stepped surface, the stepped surface includes a high surface, a low surface parallel to the high surface and closer to the base, and a connection surface located between and perpendicular to the high surface and the low surface; the connection surface defines a first through slot communicating with an inner space of the housing, the driving gear is arranged in the housing, adjacent to an inner side of the high surface, and a gear surface of the driving gear extends out through the first through slot; the second transmission gear is rotatably mounted to the low surface.

Furthermore, the housing further includes a covering plate for covering the low surface of the cover and the second transmission gear, a second through slot is defined between sides of the covering plate and the low surface, through which a gear surface of the second transmission gear extends out.

Furthermore, opposite ends of the base respectively form the second hook and the hooking portion, opposite ends of the high surface form the hooking portions, opposite ends of the covering plate form the second hooks; the second hook of the end of the covering plate adjacent to the high surface is engaged with the hooking portion of the high surface adjacent to the low surface.

By adopting the above-mentioned technical solutions, the beneficial effects of the embodiments of the present invention are as follows. The axial direction of the output shaft of the rotation power member and the axial direction of the shaft are vertically arranged. The first transmission gear which meshes with the driving gear fixed to the output shaft, the synchronous gear coaxial with and relatively fixed to the first transmission gear, and the fixed gear fixed to the shaft and meshing with the synchronous gear are provided. The shaft is relatively fixed to the support frame. When the rotation power member outputs rotary power, since the fixed gear is relatively fixed, the synchronous gear rotates about its own axis and also rotates about the axial direction of the fixed gear, and the housing of the driver and the winding drum are relatively fixed, the winding drum can rotate with the synchronous gear about the axial direction of the fixed gear to realize the winding of the shade body. The structure is simple, and moreover, the output shaft of the rotation power member and the axial direction of the shaft are arranged vertically, and thus, the space layout is reasonably used, and the occupied volume is reduced. The synchronous gear and the fixed gear are bevel gears whose axial directions are perpendicular to each other, which can effectively realize the power transmission in the vertical direction.

DETAILED DESCRIPTION OF THE INVENTION

The present application will be further described in detail below with reference to the accompanying drawings and specific embodiments. It should be understood that the following illustrative embodiments and illustrations are only used to explain the present invention and are not intended to limit the invention, and that the embodiments of the present invention and the features of the embodiments can be combined with each other without conflict.

Figure 1:
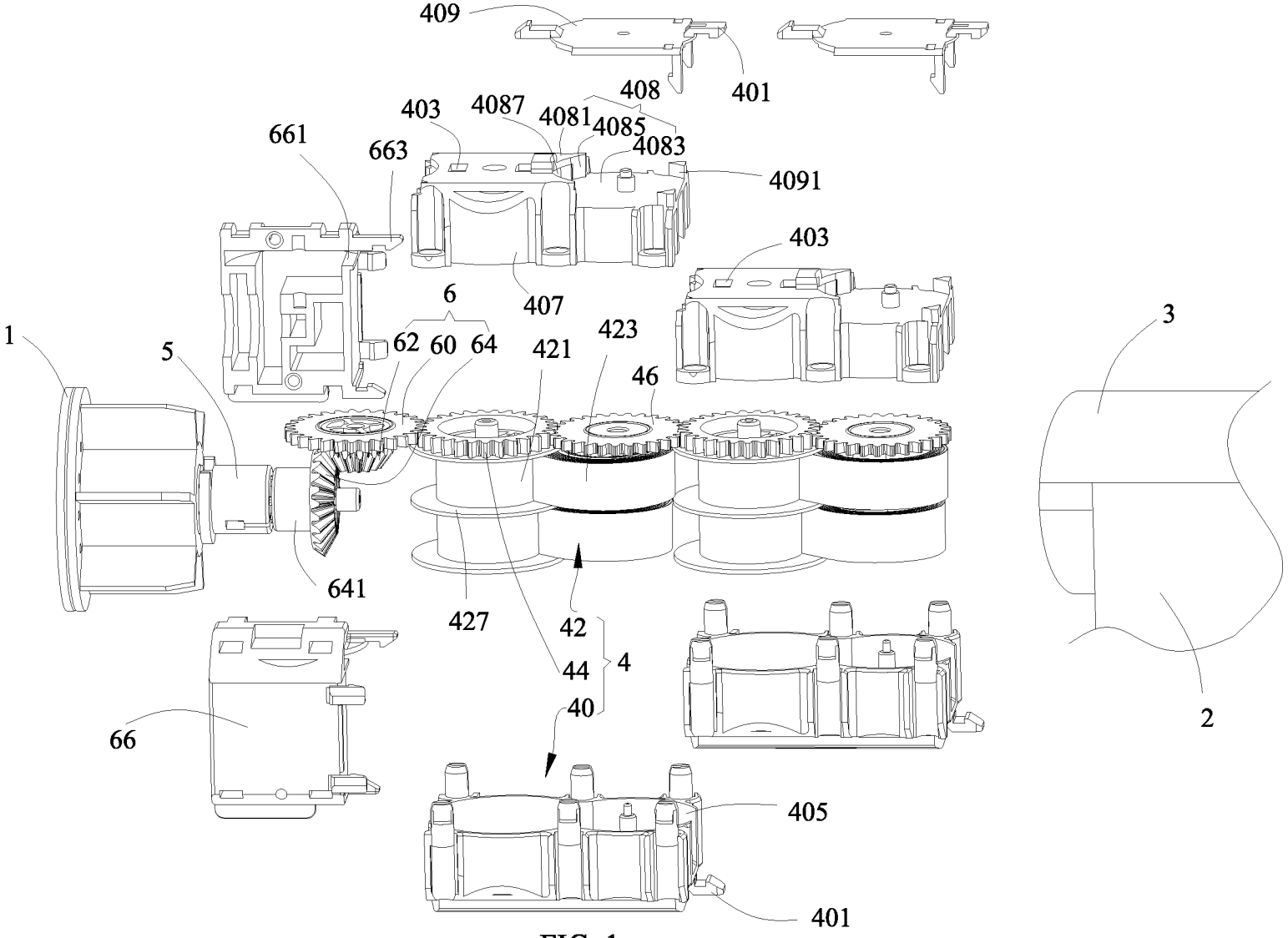
FIG. 1 is an exploded, isometric view of an embodiment of a roller shade actuation device of the present invention.
Figure 2:
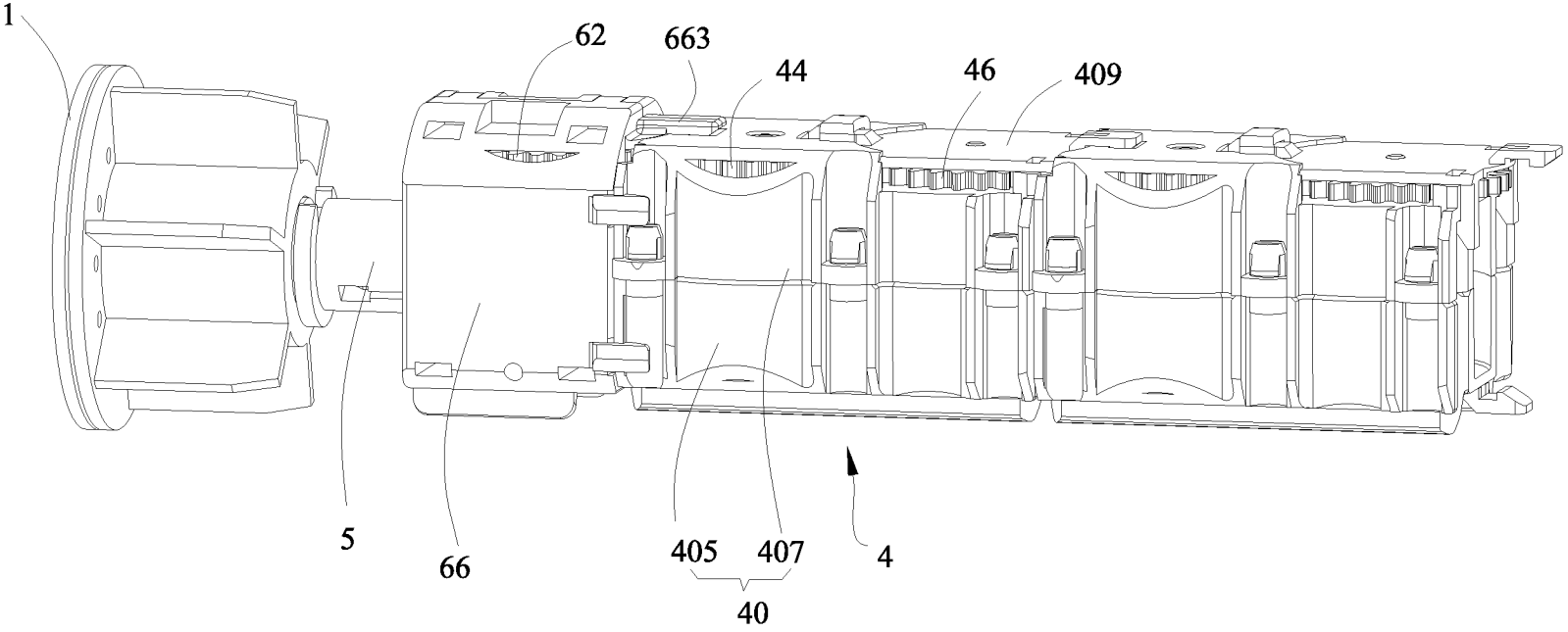
FIG. 2 is a partially assembled, isometric view of FIG. 1.
Figure 3:
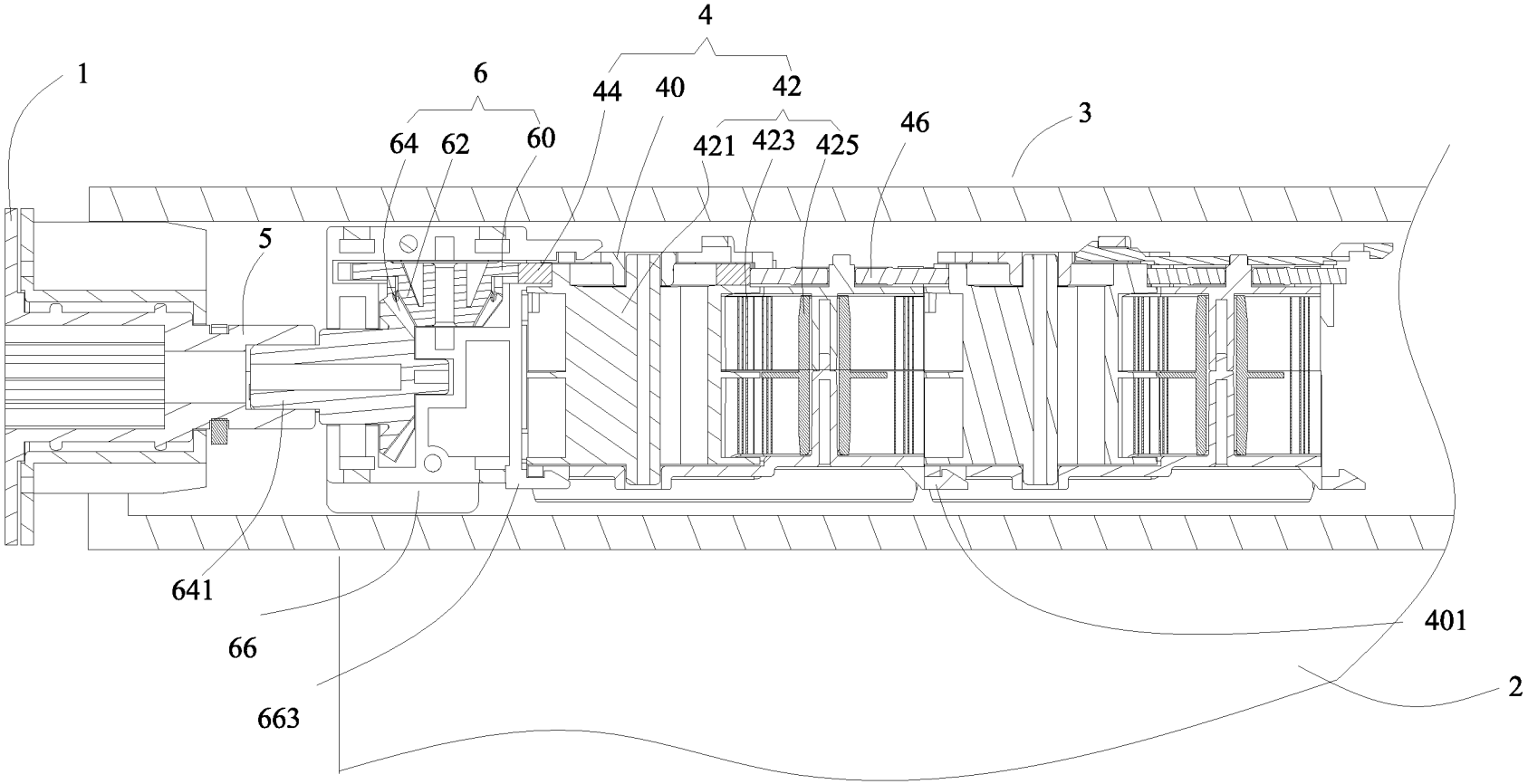
FIG. 3 is a cross-sectional view of an assembled, isometric view of FIG. 1.

Referring to FIGS. 1-3, an embodiment of the present disclosure provides a roller shade actuation device for actuating a winding drum 3. Opposite ends of the winding drum 3 are mounted to corresponding support frames 1, and an outer surface of the winding drum 3 is mounted with an end of a shade body 2. The roller shade actuation device includes a driver 4 arranged in the winding drum 3, a shaft 5 fixed to the support frame 1 outside one end of the winding drum 3 and inserted into the winding drum 3, and a transmission mechanism 6 for realizing power transmission between the driver 4 and the shaft 5. The driver 4 includes a housing 40 relatively fixed to the winding drum 3, a rotation power member 42 arranged in the housing 40, and a driving gear 44 fixed to an output shaft 421 of the rotation power member 42 and coaxial with the output shaft 421. The transmission mechanism 6 includes a first transmission gear 60 meshed with the driving gear 44, a synchronous gear 62 coaxial with and relatively fixed to the first transmission gear 62, and a fixed gear 64 fixed to the shaft 5 and meshed with the synchronous gear 62. An axial direction of the output shaft 421 of the rotation power member 42 is perpendicular to an axial direction of the shaft 5. The synchronous gear 62 and the fixed gear 64 are bevel gears whose axial directions are perpendicular to each other. In the specific implementation, the first transmission gear 60 and the synchronous gear 62 are integrally formed.

In the embodiment of the present invention, the axial direction of the output shaft 421 of the rotation power member 42 and the axial direction of the shaft 5 are perpendicularly arranged. The first transmission gear 60 which meshes with the driving gear 44 fixed to the output shaft 421, the synchronous gear 62 coaxial with and relatively fixed to the first transmission gear 60, and the fixed gear 64 fixed to the shaft 5 and meshing with the synchronous gear 62 are provided. The shaft 5 is relatively fixed to the support frame 1. When the rotation power member 42 outputs rotary power, since the fixed gear 64 is relatively fixed, the synchronous gear 62 rotates about its own axis and also rotates about the axial direction of the fixed gear 64, and the housing 40 of the driver 4 and the winding drum 3 are relatively fixed, the winding drum 3 can rotate with the synchronous gear 62 about the axial direction of the fixed gear 64 to realize the winding of the shade body 2. Moreover, the output shaft 421 of the rotation power member 42 and the axial direction of the shaft 5 are perpendicularly arranged, the structure is simple, the space layout is reasonably used, and the occupied volume is reduced. The synchronous gear 62 and the fixed gear 64 are bevel gears whose axial directions are perpendicular to each other, which can effectively realize the power transmission in the perpendicular direction.

In an alternative embodiment of the present invention, the rotation power member 42 further includes a plane scroll spring 423 and a spring winding frame 425 for winding the plane scroll spring 423. The plane scroll spring 423 and the output shaft 421 are arranged in parallel in the axial direction, and an outer end of a reed of the plane scroll spring 423 is fixed to a side surface of the output shaft 421. In the embodiment, the plane scroll spring 423 is used and the plane scroll spring 423 and the output shaft 421 are arranged in parallel in the axial direction. The plane scroll spring 423 functions as a power member to drive the output shaft to rotate, which is convenient for installation and the provided driving force has strong controllability, so that the driving force required when the shade body is retracted or released can be better designed, and the overall structure is simple, easy to assemble and easy to handle.

In another alternative embodiment of the present invention, each of the rotation power members 42 includes at least two plane scroll springs 423 that are coaxially wound on the same spring winding frame 425. The spring winding frame 425 and the output shaft 421 are respectively provided with a partition 427 that partitions adjacent plane scroll springs. In the embodiment, two plane scroll springs 423 are provided, which can make the rotation power member 42 output more effective power. The partition 427 is used for partitioning to prevent the plane scroll springs 423 from interfering with each other when winding.

In an alternative embodiment of the present invention, the first transmission gear 60, the synchronous gear 62, and the fixed gear 64 are all disposed in a gear box 66. A sidewall of the gear box 66 adjacent to the driver 4 defines a slot 661, through which the teeth of the first transmission gear 60 extends out. A gear shaft 641 of the fixed gear 64 extends through a sidewall of the gear box 66 adjacent to the shaft 5 to be fixedly connected to the shaft 5.

In the embodiment, the first transmission gear 60, the synchronous gear 62, and the fixed gear 64 are all disposed in the gear box 66, which can prevent foreign matter from entering and affecting transmission. By providing the slot 661 and allowing the gear shaft 641 of the fixed gear 64 to extend through the gear box 66 to be connected to the shaft 5, the assembly of the first transmission gear 60 and the fixed gear 64 is facilitated.

In an alternative embodiment of the present invention, the roller shade actuation device is provided with at least two sequentially linearly connected drivers 4. Each driver 4 further includes a second transmission gear 46 rotatably mounted to the housing 40 and meshed with the driving gear 44. Among them, the driving gear 44 of one driver 4 adjacent to the gear box 66 is meshed with the teeth of the first transmission gear 60 extending out of the gear box 66, and the driving gears 44 of the remaining drivers 4 are meshed with the second transmission gears 46 of the neighboring drivers 4 adjacent to the gear box 6. In the embodiment, the second transmission gear 46 connects at least two drivers 4 in series to form a driver combination. The output shafts 421 of the at least two drivers 4 are connected to a whole through the second transmission gear 46 to output power. The structure is very simple, and the output power provided by the roller shade actuation device of the present invention can be flexibly adjusted.

In an alternative embodiment of the present invention, the sidewall of the gear box 66 adjacent to the driver 4 forms a first hook 663. Opposite ends of the housing 40 of the driver 4 forms a second hook 401 and a hooking portion 403, respectively. The hooking portion 403 of the driver 4 neighboring the gear box 66 is engaged with the first hook 663 of the gear box 66, and the hooking portions 403 of the remaining drivers 4 are engaged with the second hooks 401 of the neighboring drivers 4 adjacent to the side of the gear box 66, so as to linearly connect the gear box 66 and the drivers 4 one after another. In the embodiment, the first hook 663, the second hooks 401, and the hooking portions 403 are provided to facilitate the connection and fixation of the gear box 66 and the drivers 4, and the disassembly and assembly are very convenient. In a specific implementation, the hooking portions 403 are hook holes defined in tops of the housings 40 of the drivers 4, or hook slots defined in opposite sidewalls of the housings 40.

In an alternative embodiment of the present invention, the housing 40 includes a base 405 and a cover 407 which are engaged with each other. A side surface of the cover 407 away from the base 405 is a stepped surface 408. The stepped surface 408 includes a high surface 4081, a low surface 4083 parallel to the high surface 4081 and closer to the base 405, and a connection surface 4085 located between and perpendicular to the high surface 4081 and the low surface 4083. The connection surface 4085 defines a first through slot 4087 communicating with an inner space of the housing 40. The driving gear 44 is arranged in the housing 40, adjacent to an inner side of the high surface 4081, and the gear surface of the driving gear 44 extends out through the first through slot 4087. The second transmission gear 46 is rotatably mounted to the low surface 4083. In the embodiment, the stepped surface 408 and the first through slot 4087 are provided to facilitate the assembly and transmission coordination of the driving gear 44 and the second transmission gear 46.

In an alternative embodiment of the present invention, the housing 40 further includes a covering plate 409 for covering the low surface 4083 of the cover 407 and the second transmission gear 46. A second through slot 4091 is defined between sides of the covering plate 409 and the low surface 4083, through which a gear surface of the second transmission gear 46 extends out. In the embodiment, the covering plate 409 is provided to effectively prevent external foreign matter from entering the transmission mechanism of the second transmission gear 46. The second through slot 4091 is provided, and thus, it is convenient for the transmission connection between the drivers 4, and the assembly is convenient.

In an alternative embodiment of the present invention, opposite ends of the base 405 respectively form the second hook 401 and the hooking portion 403. Opposite ends of the high surface 4081 form the hooking portions 403. Opposite ends of the covering plate 409 form the second hooks 401. The second hook 401 of the end of the covering plate 409 adjacent to the high surface 4081 is engaged with the hooking portion 403 of the high surface 4081 adjacent to the low surface 4083. In the embodiment, the hooking portions 403 and the second hooks 401 are arranged in place, to ensure stable connection between the drivers 4 and the gear box 66.

The embodiments of the present invention have been described above with reference to the drawings, while the present invention is not limited to the above-mentioned specific embodiments. The above-mentioned embodiments are only schematic, and are not intended to limit the scope of the present invention. Under the enlightenment of the present invention, those of ordinary skill in the art can also make many forms without departing from the scope of the present invention and the scope of the claims, all of which fall within the protection scope of the present invention.

What is claimed is:

1. A roller shade actuation device for actuating a winding drum with opposite ends rotatably mounted to corresponding support frames and an outer surface mounted with an end of a shade body, the roller shade actuation device comprising:

a driver arranged in the winding drum;

a shaft fixed to one of the support frames at one end of the winding drum and inserted into the winding drum; and a transmission mechanism for realizing power transmission between the driver and the shaft;

wherein the driver comprises a housing relatively fixed to the winding drum, a rotation power member arranged in the housing, and a driving gear fixed to an output shaft of the rotation power member and coaxial with the output shaft;

wherein the housing comprises a base and a cover which are engaged with each other, a side surface of the cover away from the base is a stepped surface, the stepped surface comprises a high surface, a low surface parallel to the high surface and closer to the base, and a connection surface located between and perpendicular to the high surface and the low surface; the connection surface defines a first through slot communicating with an inner space of the housing, the driving gear is arranged in the housing, adjacent to an inner side of the high surface, and a gear surface of the driving gear extends out through the first through slot;

wherein the transmission mechanism comprises a first transmission gear meshed with the driving gear, a synchronous gear coaxial with and relatively fixed to the first transmission gear, and a fixed gear fixed to the shaft and meshed with the synchronous gear; and wherein an axial direction of the output shaft of the rotation power member is perpendicular to an axial direction of the shaft, and the synchronous gear and the fixed gear are bevel gears whose axial directions are perpendicular to each other.

2. The roller shade actuation device of claim 1, wherein the rotation power member further comprises a plane scroll spring and a spring winding frame for winding the plane scroll spring, axial directions of the plane scroll spring and the output shaft are arranged in parallel, and an outer end of a reed of the plane scroll spring is fixed to a side surface of the output shaft.

3. The roller shade actuation device of claim 2, wherein the rotation power member comprises at least two plane scroll springs that are coaxially wound on the same spring winding frame, the spring winding frame and the output shaft each are provided with a partition that partitions adjacent plane scroll springs.

4. The roller shade actuation device of claim 2, wherein the first transmission gear, the synchronous gear, and the fixed gear are all disposed in a gear box, a sidewall of the gear box adjacent to the driver defines a slot, through which teeth of the first transmission gear extends out; a gear shaft of the fixed gear extends through a sidewall of the gear box adjacent to the shaft to be fixedly connected to the shaft.

5. The roller shade actuation device of claim 4, comprising at least two sequentially linearly connected drivers, wherein each driver further comprises a second transmission gear rotatably mounted to the housing and meshed with the driving gear; the driving gear of one of the drivers neighboring the gear box is meshed with the teeth of the first transmission gear extending out of the gear box, and the driving gears of the remaining drivers are meshed with the second transmission gears of the neighboring drivers adjacent to the gear box.

6. The roller shade actuation device of claim 5, wherein the sidewall of the gear box adjacent to the driver forms a first hook, opposite ends of the housing of the driver respectively form a second hook and a hooking portion; the hooking portion of the driver neighboring the gear box is engaged with the first hook of the gear box, and the hooking portions of the remaining drivers are engaged with the second hooks of the neighboring drivers adjacent to the gear box, so as to linearly connect the gear box and the drivers one after another.

7. The roller shade actuation device of claim 6, wherein the second transmission gear is rotatably mounted to the low surface.

8. The roller shade actuation device of claim 7, wherein the housing further comprises a covering plate for covering the low surface of the cover and the second transmission gear, a second through slot is defined between sides of the covering plate and the low surface, through which a gear surface of the second transmission gear extends out.

9. The roller shade actuation device of claim 8, wherein opposite ends of the base respectively form the second hook and the hooking portion, opposite ends of the high surface form the hooking portions, opposite ends of the covering plate form the second hooks; the second hook of the end of the covering plate adjacent to the high surface is engaged with the hooking portion of the high surface adjacent to the low surface.

10. The roller shade actuation device of claim 3, wherein the first transmission gear, the synchronous gear, and the fixed gear are all disposed in a gear box, a sidewall of the gear box adjacent to the driver defines a slot, through which teeth of the first transmission gear extends out; a gear shaft of the fixed gear extends through a sidewall of the gear box adjacent to the shaft to be fixed connected to the shaft.

11. The roller shade actuation device of claim 10, comprising at least two sequentially linearly connected drivers, wherein each driver further comprises a second transmission gear rotatably mounted to the housing and meshed with the driving gear; the driving gear of one of the drivers neighboring the gear box is meshed with the teeth of the first transmission gear extending out of the gear box, and the driving gears of the remaining drivers are meshed with the second transmission gears of the neighboring drivers adjacent to the gear box.

12. The roller shade actuation device of claim 11, wherein the sidewall of the gear box adjacent to the driver forms a first hook, opposite ends of the housing of the driver respectively form a second hook and a hooking portion; the hooking portion of the driver neighboring the gear box is engaged with the first hook of the gear box, and the hooking portions of the remaining drivers are engaged with the second hooks of the neighboring drivers adjacent to the gear box, so as to linearly connect the gear box and the drivers one after another.

13. The roller shade actuation device of claim 12, wherein the second transmission gear is rotatably mounted to the low surface.

14. The roller shade actuation device of claim 13, wherein the housing further comprises a covering plate for covering the low surface of the cover and the second transmission gear, a second through slot is defined between sides of the covering plate and the low surface, through which a gear surface of the second transmission gear extends out.

15. The roller shade actuation device of claim 14, wherein opposite ends of the base respectively form the second hook and the hooking portion, opposite ends of the high surface form the hooking portions, opposite ends of the covering plate form the second hooks; the second hook of the end of the covering plate adjacent to the high surface is engaged with the hooking portion of the high surface adjacent to the low surface.

* * * * *